United States Patent [19]

Morris

[11] Patent Number: 4,569,261

[45] Date of Patent: Feb. 11, 1986

[54] STAIRCASE CARPET LAYING TOOL

[76] Inventor: Joe F. Morris, Rte. 4, Box 252, Alexander, Ark. 72002

[21] Appl. No.: 691,551

[22] Filed: Jan. 15, 1985

[51] Int. Cl.[4] ..... B25B 31/00

[52] U.S. Cl. ..... 81/488

[58] Field of Search ..... 81/488; 294/8.6

[56] References Cited

U.S. PATENT DOCUMENTS 1,499,811 7/1924 Elder ..... 81/488

2,281,736 5/1942 Wittenburg ..... 81/488

*Primary Examiner*—James L. Jones, Jr.

*Attorney, Agent, or Firm*—Stephen D. Carver

[57] ABSTRACT

A portable, electrically powered carpet laying hand tool. Preferably the tool includes a gun-like member including a hand grip and a trigger which imparts reciprocal motion to a forwardly outwardly projecting terminal shaft. A carpet forcing blade assembly coupled to the muzzle of the gun member includes a pair of converging blade guards which terminate in a longitudinal, rectangular mouth through which a rigid, rather dull blade of appreciable width is reciprocated. This blade is operationally coupled to the output shaft of the gun, and it is operationally disposed within the protective blade guide assembly. Suitably angled wing guides preferably integrally associated with the blade guard portions facilitate the guiding of the reciprocating blade along and upon adjoining carpet portions while orienting the blade at approximately 45 degrees. In this manner the tool can quickly and easily be used by a workman to force carpet in between closely adjacent track strips to aid in proper carpet inlay upon perpendicularly intersecting planar members.

5 Claims, 5 Drawing Figures

STAIRCASE CARPET LAYING TOOL

BACKGROUND OF THE INVENTION

This invention relates generally to hand held carpet laying machines. More particularly, the present invention is directed to a hand held, gun-like tool adapted to facilitate the installation of carpets and associated padding within critical vertices formed between intersecting planar surfaces, such as those encountered in conjunction with staircases and the like.

In the prior art a wide variety of hand tools for aiding in the professional installation of carpet are known. As will be appreciated by those skilled in the art, normally a carpet pad or the like is stretched and placed on a floor and afterwards the carpet is properly installed thereupon. However, where the wall meets the floor or where vertices of steps are involved, it is very difficult to properly secure and fasten the carpet in a professional, workmanlike manner. Presently I am unaware of any suitable prior art tools for quickly, automatically electrically performing this very important and difficult function.

In the case of staircases, for example, a plurality of rather closely spaced-apart intersecting regions regularly occur, and it is difficult to properly lay the carpet and install the underlying padding within these regions in a workmanlike manner. The standard carpet laying procedure is to first install elongated, flat tack strips closely adjacent to and on opposite sides of the vertices. Multiple tack strips are thus typically employed on staircases in generally parallel relation on opposite sides of structural intersections, and they are commonly installed near the junction of floors and walls. When a pair of closely spaced-apart and generally parallel tack strips are properly installed above and immediately below a point of intersection, it is then possible to force the carpet into the crevice formed between adjacent tack strips by manually, forcibly wedging at least a portion of the carpet therebetween. Usually common hand tools such as an appropriately dulled chisel and a hammer are employed to drive carpet between the frictionally retaining tack strips. Those portions of the planar surfaces being covered by the carpeting between tack strips are normally covered by the mat. At best the aforedescribed installation process is relatively time consuming and imprecise, and it tires the workman and strains his patience. As a result, inefficiency and attendant labor expenses disadvantageously result.

In the prior art a variety of carpet handling machines are known for aiding in the installation of carpet. U.S. Pat. No. 3,224,092 discloses a carpet cutting machine. U.S. Pat. No. 3,538,523 discloses a carpet finishing tool adapted to aid in the cutting and setting of edges of carpet to finish in carpet inlay. The device of the latter reference includes a frame having a pair of guide wheels in conjunction with a reciprocating blade. However, the narrow crevice between tack strips is relatively innaccessible, and structure including potentially interfering parts (i.e. such as guide wheels and the like) often cannot suitably manipulate or contact that portion of the carpet to be wedged between the tack strips.

A manual carpet tucker is disclosed in U.S. Pat. No. 3,546,726. Another manual carpet trimming and finishing device is disclosed in U.S. Pat. No. 3,737,932. Of less relevance is the carpet laying tool construction seen in U.S. Pat. No. 3,790,976.

Notwithstanding the numerous hand held electrically powered hand tools of which I am aware which are aimed a carpet laying and finishing, it has been my experience that since the dimensions of the vertices between adjacent tack strips are so small, interference-free blade access to the tack strip crevice is a lacking prior art feature. In fact, I have found it to be quicker to manually pound the carpet between tack strips as described above rather than to employ known prior art machines. More particularly, after experimenting with the prototype of my invention, I have determined that an automatic electrical hand tool which functions much like a manual chisel is demanded, but because of the speed with which such a tool operates careful engineering must be employed to properly guide and control the reciprocating blade. It is necessary that the "crease" of the carpet resulting from tack strip wedging be minimal, uniform, and virtually unnoticeable. Moreover, a candidate installation hand tool must not endanger the user, while preventing damage or destruction of the carpet being installed.

SUMMARY OF THE INVENTION

The present invention comprises a gun-like, hand-held electrically powered carpet laying tool for forcing carpet in between the crevice formed between conventional tack strips.

The gun includes a reciprocating, force distributing blade which is adapted to be aimed substantially at a forty five degree angle immediately within the crevice formed between two tack strips. The blade is axially coupled to a reciprocating power output shaft, and the blade is operationally housed within a protective blade guard assembly.

Preferably the blade guard structure includes a pair of spaced apart, generally rectangular, metallic rigid plates which have spaced apart divergent ends disposed adjacent the muzzle of the hand tool and which converge toward and terminate at a substantially rectangular, slot-like mouth through which the blade is allowed to reciprocally move. A pair of preferably symmetrical wing guide members are disposed on opposite sides of the mouth and are integral with the blade guard means. Each of these wing guide members form an angle of approximately forty-five degrees with respect to the reciprocating blade, such that, as the blade guard assembly is directly forced into contact with the carpet between the tack strips, the blade is aligned to a substantially forty-five degree position.

In this manner the blade guard enables the operator to quickly achieve a very consistent angle of attack as the blade is then reciprocally engaged against the carpet. The present hand tool may thus subsequently be transversely slid along the crevice region between adjacent tack strips to neatly and uniformly install the carpet. With the present construction the automatic reciprocal blade is able to contact carpet even within extremely tight crevices which have hitherto been unreachable with prior art equipment. Moreover, no wheels or other cumbersome potentially interfering parts are necessary since the blade guards allow the apparatus to quickly slide along between tack strips, without tearing, injuring or otherwise deforming the carpet.

Significantly, the present hand tool reliably insures that the carpet is tightly, frictionally wedged between the conventional tack strips, and the subsequent unintended removal of carpet is virtually impossible. Accordingly the present device enables the workman to initially install the conventional tack strips closer together than would otherwise be possible, ultimately resulting in an ornamentally attractive and aesthetic carpet inlay substantially more attractive than the work product of prior art automatic hand tools.

Thus a broad object of the present invention is to provide a hand tool for installing carpet.

More particularly, it is a specific object of the present invention to provide an automatic, electrically powered hand tool for forcing carpet between tack strips during the carpet inlay process.

A related object of the present invention is to provide an automatic hand tool of the character described which will consistently and continuously force carpet between tack strips at a substantially constant forty five degree angle.

A related object is to provide a hand tool of the character described which is adapted to contact and penetrate extremely narrow crevices and the like. It is a feature of the present invention that no roller wheels or other interfering guide systems are employed, and that the blade arrangement disclosed herein enables the use of relatively closely spaced tack strips.

Yet another object of the present invention is to provide a tool of the character described which may be employed conveniently by an experienced workman with the use of only one hand.

A still further object of the present invention is to provide a blade guard assembly which, while it aids in automatically positioning the reciprocating blade for correct orientation, reliably insures against user injury.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
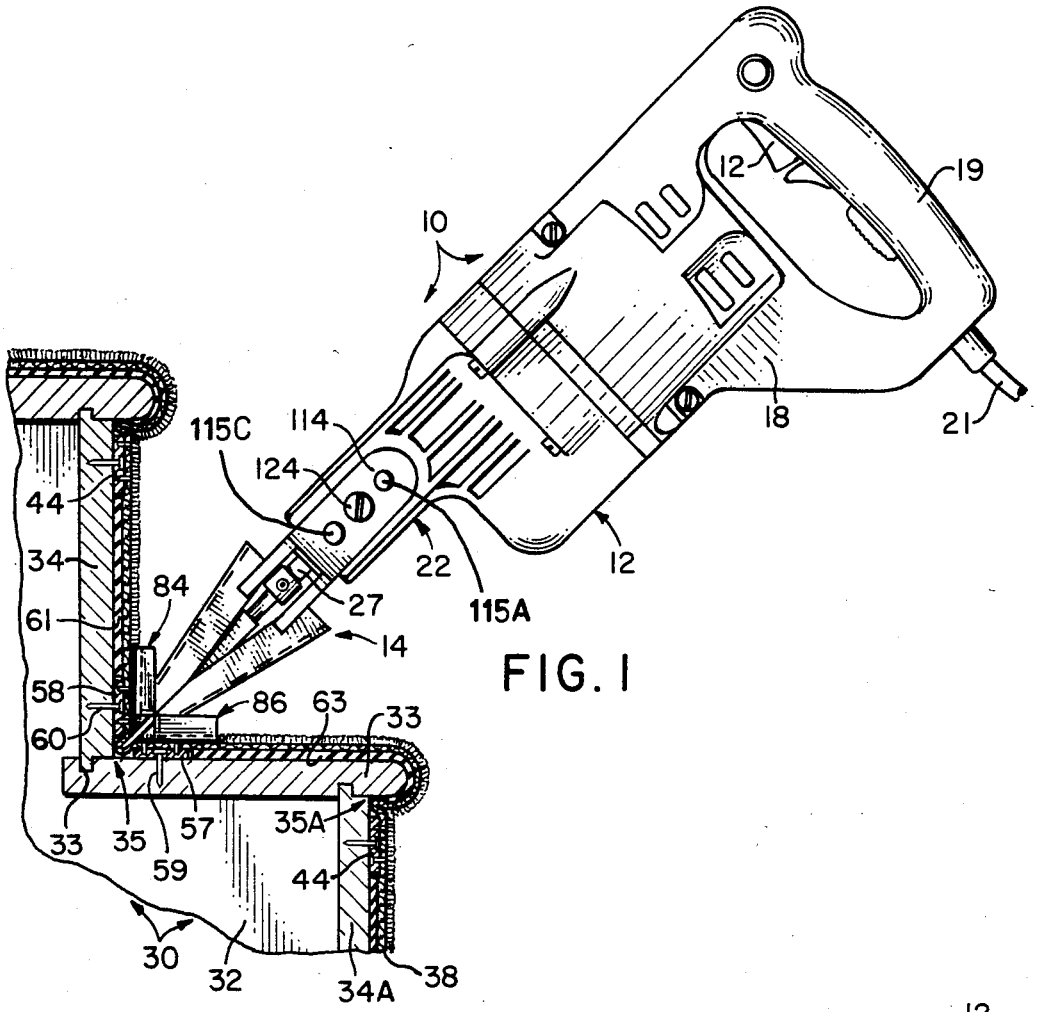
FIG. 1 is a fragmentary, pictorial view of a hand tool constructed in accordance with the best mode of the present invention, shown in operation installing carpet upon a staircase.
Figure 2:
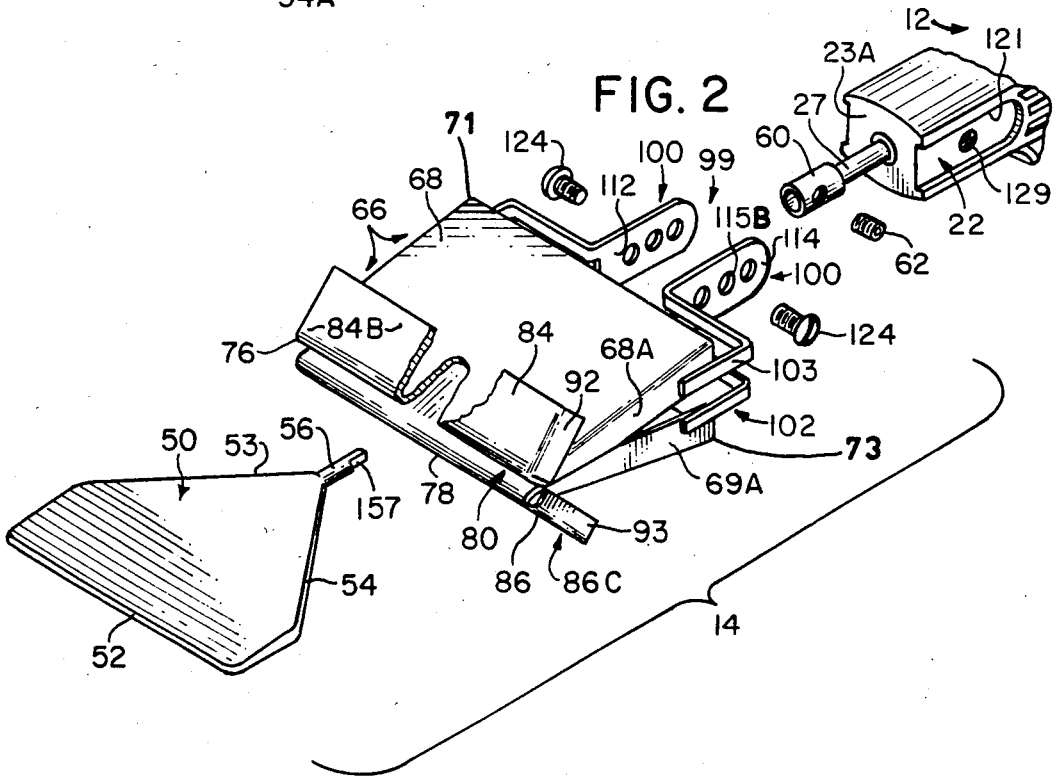
FIG. 2 is a fragmentary, exploded isometric view illustrating the carpet forcing blade assembly and a portion of the reciprocating output shaft and muzzle of the hand tool.
Figure 3:
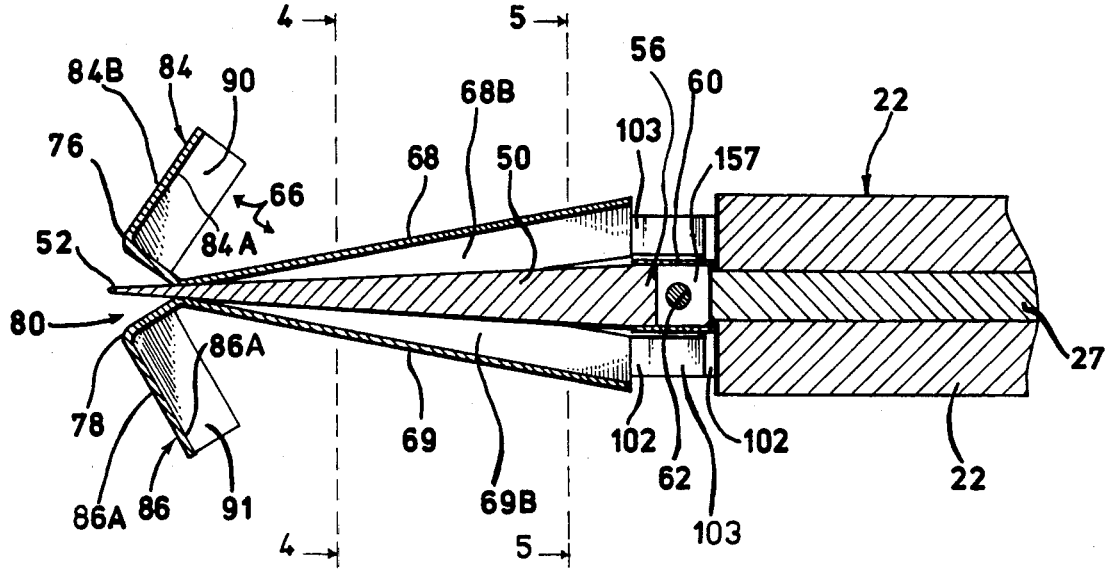
FIG. 3 is an enlarged, fragmentary, longitudinal sectional view thereof.
Figure 4:
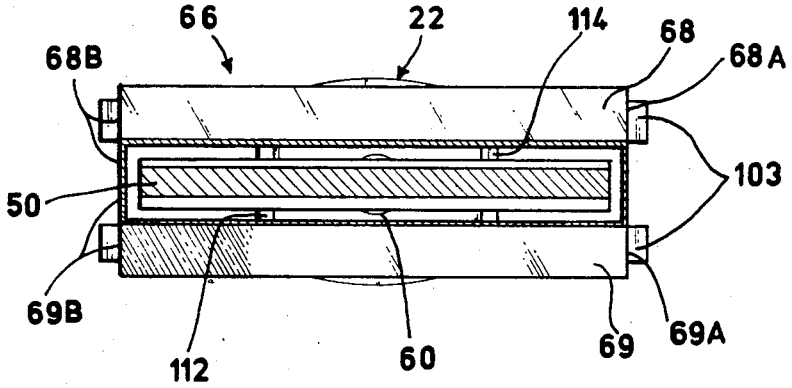
FIG. 4 is a sectional view taken generally along line 4—4 of FIG. 3.

With initial reference now to FIG. 1, a staircase carpet laying tool constructed in accordance with the best mode of the present invention has been generally designated by the reference numeral 10. My invention contemplates a conventional gun-like hand held prime mover generally designated by the reference numeral 12, which has been modified and which is preferably associated with carpet forcing blade assembly generally designated by the reference numeral 14 (FIG. 2).

The gun 12 essentially comprises a conventional electric power tool such as a Milwaukee brand, heavy duty "sawzall" which includes a rigid metallic case 18 including a hand grip portion 19 and a trigger 20. Gun 12 terminates in a forward muzzle, generally designated by the reference numeral 22, from which a generally cylindrical, forward power output shaft 27 projects. As will be appreciated by those skilled in the art, actuation of trigger 20 (providing the electrical power cord 21 has first been plugged in) will cause output shaft 27 to rapidly reciprocate. As will hereinafter be explained, the carpet forcing blade assembly 14 is adapted to be mated to the muzzle 22 of gun 12 whereby to complete the instant invention.

With further reference to FIG. 1, a conventional staircase has been generally designated by the reference numeral 30. A side portion thereof has been designated by the reference numeral 32, and a first horizontal floor member 33 intersects a first vertical member 34 and a second vertical member 34A. It will be appreciated that the members 33, 34 are oriented substantially perpendicularly with one another, and in fact substantially intersect at a vertex generally designated by the reference numeral 35. At the regions of perpendicular intersections such as vertices 35, 35A, conventional nailed tack strips, such as strip 44, are longitudinally installed in spaced relation across the intersecting members, such as pieces 34, 33. Thus a narrow crevice 35A is formed between the upper edge of staircase portion 34A and portion 33. Similarly, vertice 35 is formed between the tack strips 57 and 58 which are conventionally held in place by a plurality of nails 59, 60 respectively.

It will be appreciated that a very narrow space exists between tack strips 57 and 58, and to conventionally and professionally install carpet, it is the usual practice to forceably lodge at least a portion of the carpet therebetween in wedged relation. As described before, this is usually accomplished by hand tools, but the reciprocating action of the present structure facilitates quick and easy forcing of carpet between the tack strips 57 and 58. Also illustrated in FIG. 1 is the conventional carpet padding, portions 61 and 63 of which are located between tack strips.

With additional reference now to FIGS. 2 through 5, the carpet forcing blade assembly 14 includes a rigid blade generally designated by the reference numeral 50, which include a full leading edge 52 adapted to be forced between the tack strips. Although the body of blade 50 is substantially rectangular, it will be apparent that sides 53, 54 thereof converge rearwardly forming reduced width portions. These edges 53, 54 generally converge in an integral, preferably cylindrical keyed shaft 56 upon which key 157 is defined. Preferably the blade is axially coupled to the reciprocating shaft 27 by a collar 60 which is secured to the keyed cylinder 56 of the blade means by a conventional screw 62. Thus it will be appreciated that as reciprocating shaft 27 moves inwardly and outwardly with respect to muzzle 22, the blade 50 will similarly be forced to move inwardly and outwardly with respect to the blade guard means generally designated by the reference numeral 66.

Figure 5:
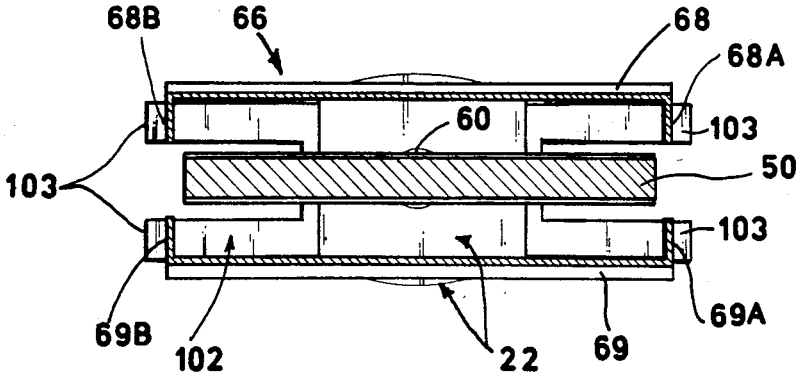
FIG. 5 is a sectional view taken generally along line 5—5 of FIG. 3.

Blade guard means 66 comprises a pair of generally rectangular, rigid, planar metallic sheets 68 and 69, which have spaced apart diverging ends 71, 73 which terminate closely adjacent the end portion 23A of muzzle 22. Guard portions 68, 69 converge forwardly in closely spaced apart ends generally designated by the reference numeral 76, 78. Sides 68A, 69A, 68B, and 69B are illustrated in FIG. 5. As best viewed in FIG. 2, an elongated, generally rectangular mouth, generally designated by the reference numeral 80, is thus formed between these parallel converging blade guard ends, and this mouth is occupied and penetrated by reciprocating blade 50.

Preferably a pair of wing guide members 84 and 86 originate from the ends 76, 78 of the blade guard members 68, 69. The inner portions 84A and 86A of the wing guide members are preferably integral with the blade guard members 68, 69 previously discussed. Moreover, they include integral, curved and perpendicular portions 84B and 86C forming planar surfaces which, as will hereinafter be described, are adapted to slide along the carpet being installed in a longitudinal motion during operation of the machine. Also illustrated are side portions 90 through 93 (FIGS. 1 and 2).

Preferably a pair of fork members, generally designated by the reference numeral 99, are employed to mount the blade guard assembly 14 to the muzzle 22 of gun 12. To this effect it will be apparent that each fork member 99 includes first, spaced-apart end portions generally designated by the reference numeral 102, each of which comprises a pair of spaced-apart fork like projections 103. Portions 103 are secured as by welding or the like to the divergent end portions of the blade guard assembly 14. The fork members 99 include a pair of integral, more closely spaced apart tabs generally designated by the reference numeral 100. The inner tab portions 112, 114 of the fork members include a plurality of mounting holes such as apertures 115A, 115B, 115C, which facilitate mounting to the muzzle 22 of the gun. In this regard it will be apparent that the parallel tabs 112, 114 fit closely adjacent opposite sides of the gun muzzle 22, being neatly received within the recessed regions generally designated by the reference numeral 121 defined thereupon. Conventional screws 124 are employed to secure these fork mount tab portions 112, 114 on opposite sides of muzzle 22, being received within suitable tapped orifices 129. The operative clearance of blade 50 relative to mouth 80 may be varied by adjusting the spacing, and thus operative position of, the wing guide structure by proper selection of mounting holes 115A, 115B, or 115C.

Thus with the apparatus assembled in accordance with the aforedescribed mode of the invention, the operator may grasp the invention 10 and depress trigger 20 to impart a rapidly reciprocating motion to blade 50 previously described. Then the entire gun may be forced into engagement within the crevice formed by intersecting planar members 33, 34, such that the blade tip 52 is forced in the crevice 35 (FIG. 1). As the blade reciprocates it forces the carpet within crevice 35, tightly between spaced-apart tack strips 58, 57 whereby to frictionally wedge the carpet therebetwen. The gun is moved across the longitudinal length of the crevice (i.e. toward and away from the viewer of FIG. 1) to secure the carpet along the entire intersection edge. It will also be appreciated that at this time the wing guide members 84, 86 will constantly maintain the blade 50 at substantially 45 degrees with respect to either vertical member 34 or horizontal member 63. To this effect it will be appreciated from an inspection of FIG. 2 that the wing guide portions 84B, 86C are oriented at an angle of approximately 45 degrees with respect to the longitudinal axis of the reciprocating blade 50.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable electrically powered hand tool for installing carpet in difficult areas such as the corner sections of staircases and the like; said tool comprising;

generally gun shaped electrically powered, hand held means having a hand grip, a selectively actuable trigger, and a reciprocating forward output shaft emanating from a forward muzzle; and;

a carpet forcing blade assembly comprising:

rigid blade means having a transverse terminal end of substantial width, said blade means terminating in a spaced-apart reduced width portion adapted to be secured to said output shaft;

blade guard means comprising a pair of spaced-apart, generally rectangular rigid plates having spaced-apart divergent ends disposed adjacent said muzzle in substantially covering relation with respect to said output shaft and opposite closely spaced-apart ends which terminate slightly short of convergence;

a blade output mouth longitudinally disposed between said opposite ends of said blade guard means plates through which the blade means terminal end is free to reciprocally move; and, a pair of wing guide members disposed on opposite sides of said mouth and rigidly secured to said opposite ends of said plates, said wing guide members adapted to contact each one of a pair of generally perpendicular planar members upon which carpet is to be installed when said blade means is directed toward the intersecting point of said planar members, whereby to orient said blade means at an operative orientation of approximately forty five degrees with respect to both of said last mentioned planar members.

2. The hand tool as defined in claim 1 wherein said wing guide members are each disposed substantially at an angle of approximately 45 degrees with respect to said blade means.

3. The hand tool as defined in claim 2 including a pair of rigid parallel cooperating mounting fork members secured to opposite sides of the rear of said blade guard means and terminating in closely spaced-apart parallel mounting tabs adapted to be secured to said muzzle on opposite sides thereof whereby to mount said blade assembly to said hand held gun means.

4. The hand tool as defined in claim 3 wherein said terminal end of said blade means comprises a keyed cylinder, and said forward output shaft comprises collar means adapted to receive and secure said cylinder to said reciprocating forward output shaft.

5. The hand tool as defined in claim 4 wherein said wing guide members are integral with said blade guard means.

* * * * *